United States Patent [19]

Phillips

[11] Patent Number: 4,653,066

[45] Date of Patent: Mar. 24, 1987

[54] ELECTRODE HOLDER ASSEMBLY AND ELECTRODE CLAMP FOR ELECTRIC ARC FURNACES

[75] Inventor: Donald L. Phillips, Hayden, Ala.

[73] Assignee: Dixie Arc, Inc., Brimingham, Ala.

[21] Appl. No.: 599,264

[22] Filed: Apr. 11, 1984

[51] Int. Cl.[4] ..... H05B 7/101

[52] U.S. Cl. ..... 373/94; 373/99

[58] Field of Search ..... 373/94–101

[56] References Cited

U.S. PATENT DOCUMENTS

| | | | |
|---|---|---|---|
| 2,335,344 | 11/1943 | Le Tourneau | 373/98 |
| 3,379,816 | 4/1968 | Hozven | 373/99 |
| 4,182,927 | 1/1980 | Phillips | 373/99 |
| 4,385,391 | 5/1983 | Hillers et al. | 373/99 |

FOREIGN PATENT DOCUMENTS

| | | | |
|---|---|---|---|
| 426334 | 4/1974 | U.S.S.R. | 373/101 |

*Primary Examiner*—Roy N. Envall, Jr.

*Attorney, Agent, or Firm*—Renner, Otto, Boisselle & Lyon

[57] ABSTRACT

An electrode holder assembly for a cylindrical electric arc melting furnace permits reduction of the electrode pitch circle diameter spacing the electrodes farther from the refractory lining reducing refractory wear and lengthening cycles between relining. The assembly also permits more power to be introduced while reducing overall reactance, both resulting in a more efficient furnace. The arrangement also provides reduced melting time in turn resulting in more furnace capacity, thus reducing electrode consumption per ton of molten metal. The arrangement is achieved by an improved simplified and compact differential clamp mounted inboard of a relatively thin U-shape clamp enabling the distal ends of the two outer arms of the three mast arms employed to be angled toward each other and the center mast arm to reduce the diameter of the electrode pitch circle.

29 Claims, 6 Drawing Figures

ELECTRODE HOLDER ASSEMBLY AND ELECTRODE CLAMP FOR ELECTRIC ARC FURNACES

This invention relates generally as indicated to an electrode holder assembly and electrode clamp for electric arc furnaces and more particularly to such an assembly permitting the reduction of the electrode pitch circle diameter.

BACKGROUND OF THE INVENTION

Water cooled electrode holder assemblies for electric arc furnaces involve complex electrode clamping assemblies mounted on the distal ends of mast arms which project over the top of a generally cylindrical furnace vessel. Typical such assemblies are seen in Turner U.S. Pat. No. 3,444,305 dated May 13, 1969 and applicant's prior U.S. Pat. No. 4,182,927 dated Jan. 8, 1980. The present invention constitutes certain improvements over the holder assemblies shown and described in such prior patents.

Such holder assemblies normally include three electrodes which are positioned in the center of the cylindrical vessel forming an electrode pitch circle or a circle through which the axes of the electrodes extend, each electrode being equally circumferentially spaced around such pitch circle.

It will be appreciated that the larger the pitch circle, the closer the electrodes are positioned to the cylindrical refractory lined wall of the furnace vessel. It will also be appreciated that the larger the pitch circle diameter, the farther apart are the three electrodes. Thus if the electrodes can be positioned fairly close to each other by reducing the electrode pitch circle diameter, certain advantages in the operation of the furnace may be achieved. Such advantages are positioning the electrodes farther from the refractory lining of the cylindrical wall of the vessel resulting in reduced refractory wear. The relining of any furnace or the repair of that lining is an expensive undertaking resulting in substantial down time for the furnace. Thus if the lining life can be extended, substantial economies are achieved.

In addition, a reduced electrode pitch circle diameter permits more power to be introduced to the electrodes, and also reduces overall reactance allowing more power to be supplied to the electrodes, both providing better furnace efficiency. A reduced pitch circle diameter also results in reduced melting time resulting in more furnace capacity, thus reducing the electrode consumption per ton of molten metal.

It is also desirable in an electrode clamping assembly to utilize a differential clamp such as shown in applicant's prior U.S. Pat. No. 4,182,927, but in a more improved, simplified and compact form, such clamp being positioned on the inboard side of a relatively thin U-shape clamp, in this manner enabling the distal ends of the two outer arms of the three mast arms employed to be angled toward each other and the center mast arm in order to reduce the diameter of the electrode pitch circle.

SUMMARY OF THE INVENTION

The present invention utilizes an improved, simplified and highly compact differential clamp of the type shown in applicant's prior U.S. Pat. No. 4,182,927, which can be positioned inboard of a relatively thin U-shape clamp and which can readily be protected from the heat of the furnace. In this manner the distal ends of the outer two mast arms of the three mast arms employed may be angled toward each other and the center mast arm and the electrode held thereby. This permits the electrodes to be positioned closely adjacent each other on a reduced diameter electrode pitch circle. In addition to the simplified clamp, the electrodes may thus be spaced farther from the refractory lining walls, resulting in reduced refractory wear. The smaller pitch circle diameter also permits more power to be introduced to the electrodes as well as reducing the overall reactance providing for better furnace efficiency. This also results in reduced melting time reducing the electrode consumption per ton of molten metal.

The improved differential clamp includes a one-piece cylinder which may be of uniform or stepped diameter. A Belleville spring assembly within the cylinder provides the electrode clamping force which may be supplemented by fluid pressure. The clamping assembly may act to pull a relatively thin U-shape clamp toward the electrode held by a fixed smaller clamp or push the smaller clamp toward the relatively thin U-shape clamp. The compact arrangement of the clamp with relatively few parts employed enables the clamp to be positioned on the inboard side of the relatively thin U-shape clamp to provide adequate clearance around the electrode holders so that the electrode pitch circle diameter may be minimized. The compact nature of the differential clamp also permits the clamp readily to be isolated from the heat of the furnace by water cooled plates, cylinders, or the like.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE DRAWINGS

Figure 1:
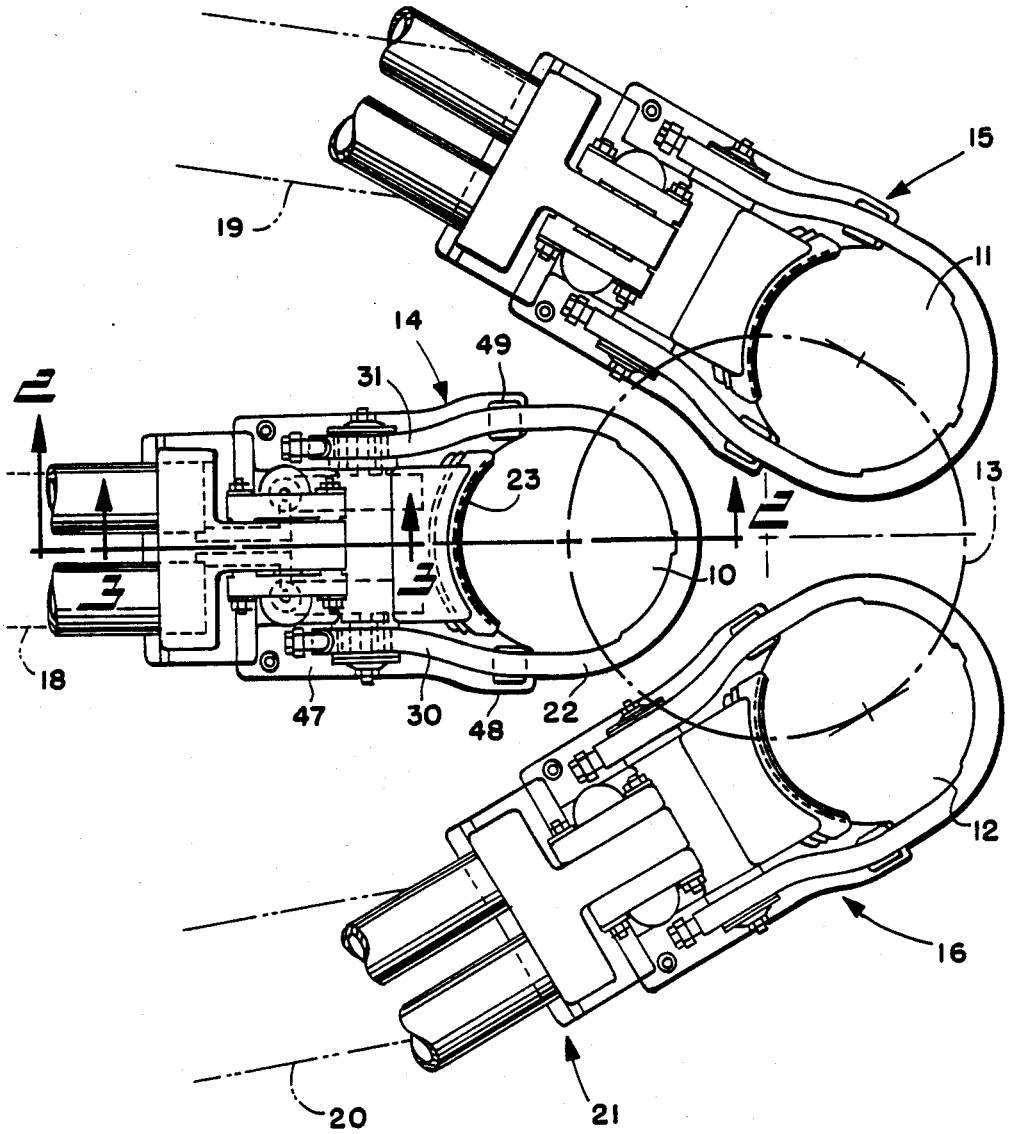
FIG. 1 is a top plan view of the distal ends of the three mast arms forming the electrode holder assembly of the present invention.

Referring first to FIGS. 1, 2, 3 and 4, and initially to FIG. 1, there is illustrated the three electrodes of the furnace in top plan view as indicated by the smaller circles 10, 11 and 12, the centers of which are positioned equidistant about the pitch diameter circle 13. It will be appreciated that the electrodes are vertically extending graphite or like rods which are held by electrode clamp assemblies 14, 15 and 16, respectively, positioned on the distal ends of mast arms 18, 19, and 20, respectively.

It is noted that the two outer mast arms include a distal end offset or bend indicated at 21 with the holder assembly being positioned at an inwardly directed angle to the main axis of the respective mast arms 19 and 20, symmetrically about the axis of the center mast arm 18. The clean and compact construction of the electrode holder assemblies permits the holder assemblies and mast arms to be arranged and constructed in the manner indicated to reduce the diameter of pitch circle 13.

Other than the orientation of the distal ends of the outer mast arms 19 and 20, the clamp assemblies 14, 15 and 16 are essentially the same, and only the clamp assembly 14 will be described in detail.

Figure 2:
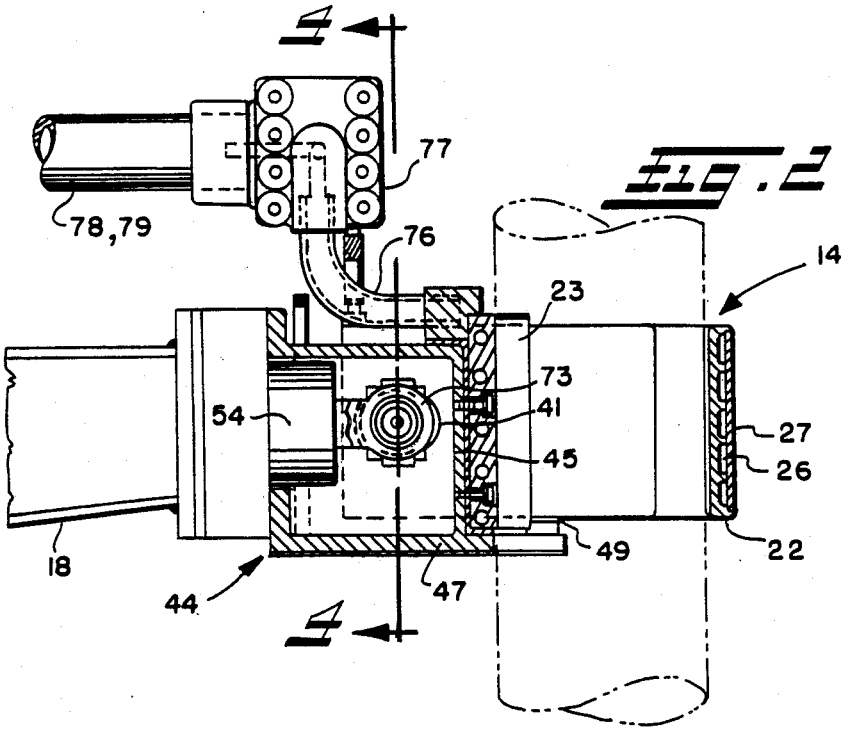
FIG. 2 is a vertical section through the center electrode holder assembly as seen from the line 2—2 of FIG. 1.
Figure 4:
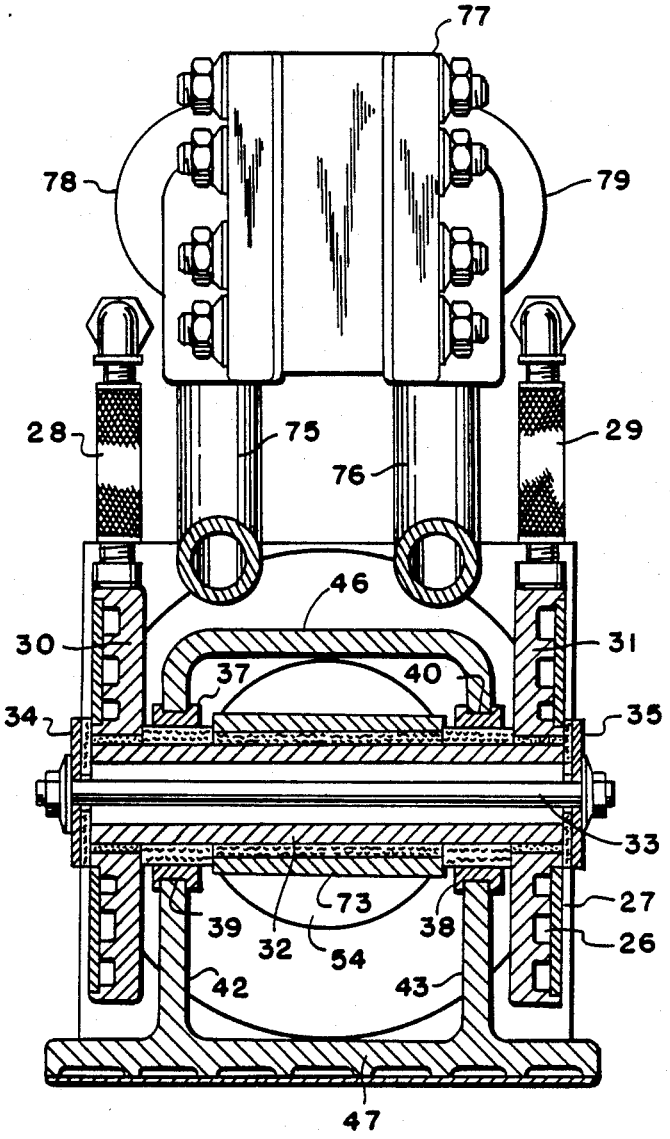
FIG. 4 is an enlarged vertical section taken through the clamp connection as seen from the line 4—4 of FIG. 2.

Referring now to FIGS. 1 and 2, it will be seen that the clamp assembly 14 includes a relatively thin outer U-shape clamp element 22 in the form of a horseshoe which cooperates with smaller circular clamp element 23 which is on the interior of the clamp 22 and on the inboard side of the electrode holder assembly. As indicated in FIGS. 2 and 4, the horseshoe clamp includes a plurality of passages 26 which may be milled in the outer face thereof and covered by plate 27. Cooling water is circulated through such passages by means of conduits 28 and 29 seen in FIG. 4.

The legs of the U-shape or horseshoe clamp 22 seen at 30 and 31 are interconnected by a tubular pin through which extends tie rod 33 which holds washer assemblies 34 and 35 against the outer faces of the legs of the horseshoe clamp. The tubular pin 32 also extends through opposed paired saddles 37 and 38 which are slidably mounted on the horizontal top and bottom edges 39 and 40 of holes 41 in side walls 42 and 43 of frame 44. In addition to the side walls the frame includes a front wall 45 on which the clamp 23 is mounted, a top wall 46, a bottom wall 47, also provided with coolant passages, which extends forwardly of the circular clamp element 23 on each side thereof and flares slightly as indicated at 48 supporting the horseshoe clamp in horizontal position as indicated at 49. In addition to its other functions, the frame 44 is a cooling box.

The frame also includes a back wall 51 provided with an annular hole 52 near the top thereof. The hole accommodates reduced diameter extension 54 of one piece cylinder 55 of the differential clamp shown generally at 56. The frame 44 is mounted on the end of mast arm 18 by the fasteners 58 which extend through the larger diameter wall of the one piece cylinder 55. As indicated, both the larger and smaller diameters of the one piece cylinder may be provided with coolant passages seen at 60 and 61, respectively. The fasteners also extend through the blind end plate 63 of the piston cylinder assembly to which the one piece cylinder is sealed. The opposite end of the cylinder assembly is sealed by an adjustable smaller end plate 64 threaded into the smaller cylinder extension 54 as indicated at 65. The larger cylinder portion is provided with a piston 66 which includes a one piece rod 67 extending through the adjustable end plate 64. A Belleville spring assembly 69 extends between the adjustable end plate and the piston 66 along the rod 67.

The rod portion 67 of the piston is hollow and a sealed fastener 72 extends therethrough securing rod eye 73 to the projecting end of the piston rod. The rod eye is mounted on the tubular pin 32, within the frame 44.

Figure 3:
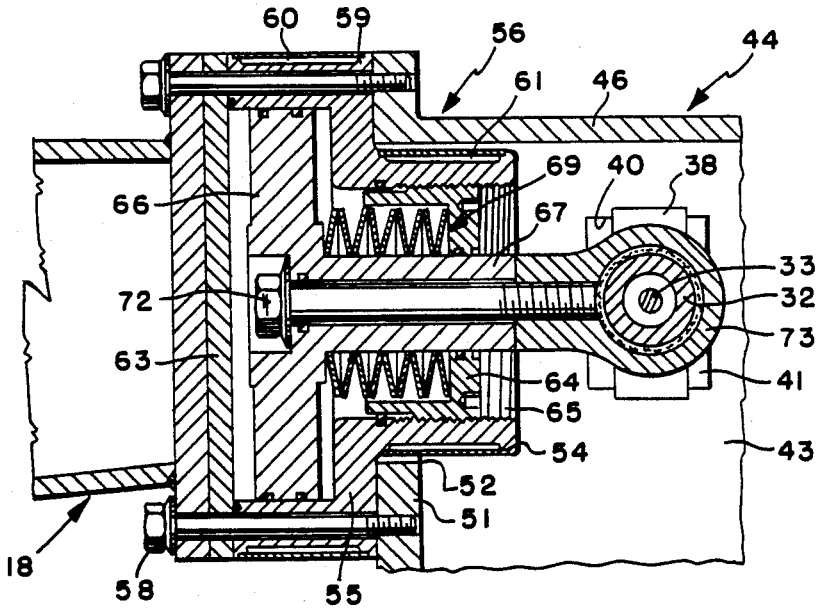
FIG. 3 is an enlarged vertical section taken through the differential clamp of the center electrode holder as seen from the line 3—3 of FIG. 1.

It will now be seen that the Belleville spring assembly 69 in the reduced diameter portion of the one piece cylinder urges the piston 66 to the left as seen in FIGS. 2 and 3 pulling the horseshoe clamp 22 also to the left clamping the electrode 10 against the interior fixed shoe or clamp element 23. Fluid pressure media may also be provided on opposite sides of the piston both to release the electrode by moving the horseshoe clamp to the right as seen in FIG. 2 or to assist the Belleville spring in clamping the electrode in place.

Electricity is provided to the clamping elements through water cooled tubes 75 and 76 which extend downwardly from clamps 77 securing such tubes to the end of tubular buses 78 and 79.

As illustrated the differential clamp 56 is of quite compact nature and of simplified construction involving a one piece cylinder, two end plates, one of which is adjustable, and a one piece cylinder and rod to which the rod eye may readily be connected. In this manner the differential clamp readily fits within the frame 44 and is readily protected by the cooled bottom wall 47.

Figure 5:
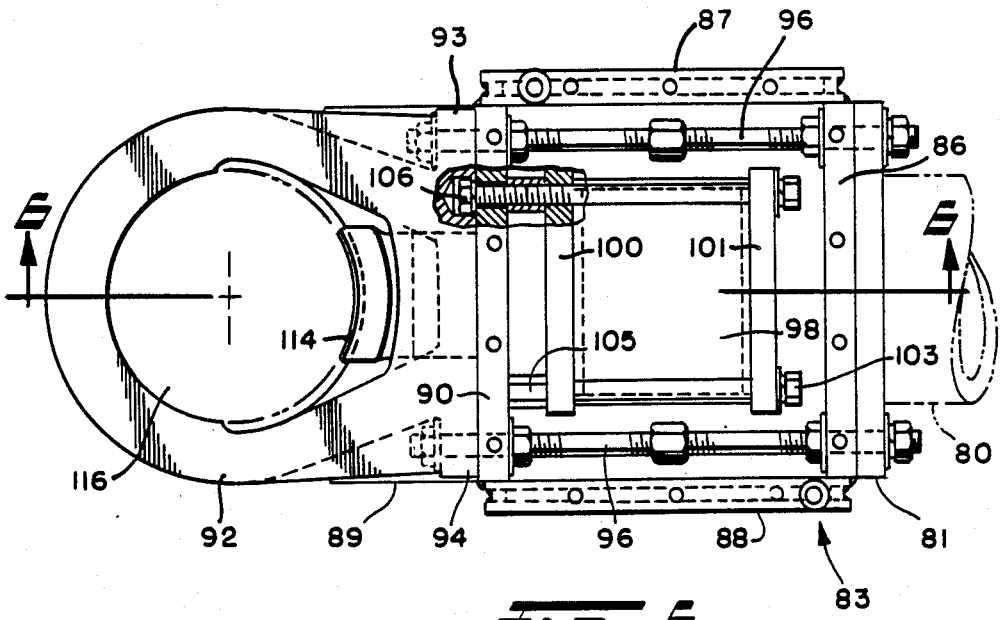
FIG. 5 is a fragmentary top plan view of another form of clamp in accordance with the present invention.
Figure 6:
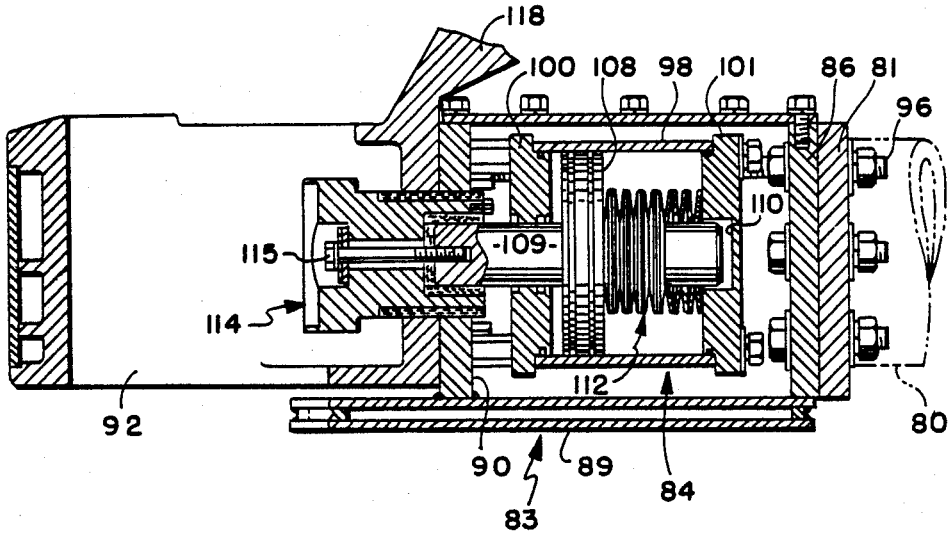
FIG. 6 is a vertical section through the clamp of FIG. 5 taken substantially on the line 6—6 thereof.

It will be appreciated that the embodiment of FIGS. 1–4 illustrates a pull-type electrode clamp. In FIGS. 5 and 6 there is illustrated a push-type clamp, such clamp however again being positioned on the inboard side on the distal end of the mast arm and enabling the employment of a rather thin horseshoe type clamp which in turn enables the two outer electrodes to be mounted on mast arms which are angled or bent toward each other, thus reducing the diameter of the electrode pitch circle 13.

In FIGS. 5 and 6 there is illustrated the mast arm 80 which includes a vertical plate 81. For the outer two mast arms the plate may be set at an angle to the mast arms but still in a vertical plane. A cooling box shown generally at 83 is mounted on such plate and within such cooling box there is provided a compact and simplified differential clamp 84. The cooling box includes a back wall 86, side walls 87 and 88 and a bottom wall 89 which extends forwardly of front wall 90. As illustrated, at least the side and bottom walls may be formed of separated plates providing a chamber or chambers for flow of cooling water therethrough.

Horseshoe shape outer clamp 92 is mounted on the front wall 90 of the cooling box and includes outwardly directed flanges 93 and 94. The horseshoe clamp, cooling box, and mast arm are secured together by elongated stud bolt assemblies 96, there being three on each side of the differential clamp. Such stud bolt assemblies extend through the wall 81 of the mast arm, the rear wall 86 of the cooling box, the front wall 90 of the cooling box and the outwardly directed flanges 93 and 94 on the horsehoeshape clamp.

The clamp actuator comprises a one piece cylinder confined and sealed between cylinder ends 100 and 101, such cylinder assembly being mounted by means of corner bolts 103 and hex nipples 105 secured to the interior of the cooling box front wall 90 by fasteners 106 extending through such wall. The piston 108 includes an integrally formed rod 109 which extends essentially the same distance fore and aft of the piston. The aft end of the rod fits within a recess 110 in the blind end wall of the cylinder 101. A Belleville spring assembly 112 fits around the aft end of the piston extending between the cylinder wall 101 and the piston 108. The forward end of the piston telescopes within clamping shoe or element 114 and is secured thereto by fastener 115. The inner or inboard clamping element 114 is mounted for sliding movement not only through the interior wall 116 of the horseshoe shape clamp, but also the outer wall 90 of the cooling box.

The Belleville spring assembly 112 will provide the normal clamping force for securing the vertically extending electrode in the position 116. Fluid pressure will be applied to the opposite side of the piston for unclamping the electrode and may also be applied to the same side of the piston as the Belleville spring assembly to assist the clamping force.

Electric current may be supplied to the holder assembly through bracket 118 connected to bus tubes in the usual manner.

It can now be seen that there is provided either a push or pull type electrode holder clamp utilizing a compact short stroke simplified differential clamp which is situated on the inboard side of the horseshoe clamp and which, because of its compact nature, can readily be protected from the heat of the furnace. Moreover, the arrangement provides a simplified and clean electrode holder assembly on the distal end of the mast arm which enables the two outer mast arms to be angled reducing the diameter of the electrode pitch circle as seen in FIG. 1. This arrangement results in a number of efficiencies and economies in the operation of the furnace.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

I claim:

1. An electrode holder assembly for an electrical furnace comprising three mast arms for extension over such furnace, each of said mast arms having a distal end, said distal end of each of said mast arms having connected thereto a holder for supporting an electrode, each of said holders comprising a distal, substantially U-shaped clamping member, an internal clamping member, and means operative to apply a relative force between said distal U-shape clamping member and said internal clamping member to hold one of such electrodes therebetween, each of said distal U-shape clampinng members essentially encircling one of such electrodes and one of said internal clamping members, each of said means operative to apply a relative force being located between said distal end of each of said mast arms and said internal clamping member of each of said holders, said three mast arms comprising a center mast arm and two outer mast arms, said two outer mast arms each including a bend and a distal bend portion, said bends causing said distal bend portions to extend at an angle with respect to said center mast arm to place such electrodes supported by said holders in a small radius circle at substantially the center of such furnace.

2. An electrode holder assembly for supporting a plurality of electrodes within an electrical furnace comprising three mast arms for extension over such furnace, each of said mast arms comprising a holder comprised of a distal U-shape clamping member essentially encircling one of such electrodes, an internal clamping member, and means operative to apply a relative force between each said distal, substantially U-shaped clamping member and said internal clamping member to hold one of such electrodes therebetween, said three mast arms comprising a center mast arm and two outer mast arms, said two outer mast arms each including a bend and a distal bent portion, said bends causing said distal bent portions to extend at an angle with respect to said center mast arm to place such electrodes supported by said holders equidistant around a small electrode pitch circle substantially adjacent each other.

3. An electrode holder assembly as set forth in claim 2 wherein each of said means operative to apply a relative force is located in the immediate proximity of the distal end of said respective mast arm inboard of said internal clamping member.

4. An electrode holder assembly as set forth in claim 2 wherein each of said means operative to apply a relative force comprises an actuator, said actuator comprising a one-piece cylinder.

5. An electrode holder as set forth in claim 4, wherein said one-piece cylinder is of uniform diameter.

6. An electrode holder as set forth in claim 4 wherein said one-piece cylinder has tandem cylinders of two diameters.

7. An electrode holder as set forth in claim 4 including an integrally formed piston and rod for said actuator.

8. An electrode holder as set forth in claim 7 including a Belleville spring assembly surrounding at least one extension of said rod from said piston to assist clamping one such electrode in each of said holders.

9. An electrode holder as set forth in claim 8 wherein said Belleville spring assembly extends around said rod operative to force said piston to a clamping position of such electrode.

10. An electrode holder assembly as set forth in claim 9 wherein said Belleville spring assembly is on the interior of said piston operative to force the latter away from the electrode to pull the U-shape clamping member toward the internal clamping member.

11. An electrode holder assembly as set forth in claim 9 wherein said Belleville spring assembly is on the exterior of said piston to force the latter toward the electrode to force the internal clamping member toward the distal U-shape member.

12. An electrode holder assembly as set forth in claim 4 including a cooling box protecting said actuator from the heat of such furnace.

13. An electrode holder assembly as set forth in claim 12 wherein said cooling box includes coolant passages in the cylindrical surfaces of the cylindrical portion of said actuator.

14. An electrode holder assembly as set forth in claim 12 wherein said cooling box includes at least bottom and side walls subject to such cooling to protect the actuator from the heat fo the furnace.

15. An electrode holder assembly as set forth in claim 3 wherein each of said means operative to apply a relative force comprises an actuator, said actuator comprising a one-piece cylinder.

16. An electrode holder as set forth in claim 15 wherein said one-piece cylinder is of uniform diameter.

17. An electrode holder as set forth in claim 15 wherein said one-piece cylinder has two diameters.

18. An electrode holder as set forth in claim 15 including an integrally formed piston and rod for said actuator.

19. An electrode holder as set forth in claim 18 including a Belleville spring assembly surrounding at least one extension of said rod from said piston to assist clamping one such electrode in each of said holders.

20. An electrode holder as set forth in claim 19 wherein said Belleville spring assembly extends around said rod operative to force said piston to a clamping position of such electrode.

21. An electrode holder assembly as set forth in claim 20 wherein said Belleville spring assembly is on the interior of said piston operative to force the latter away from the electrode to pull the U-shape clamping member toward the internal clamping member.

22. An electrode holder assembly as set forth in claim 20 wherein said Belleville spring assembly is on the exterior of said piston to force the latter toward the electrode to force the internal clamping member toward the distal U-shape member.

23. An electrode holder assembly as set forth in claim 15 including a cooling box protecting said actuator from the heat of such furnace.

24. An electrode holder assembly as set forth in claim 23 wherein said cooling box includes coolant passages in the cylindrical surfaces of the cylindrical portions of said actuator.

25. An electrode holder assembly as set forth in claim 23 wherein said cooling box includes at least bottom and side walls subject to such cooling to protect the actuator from the heat of the furnace.

26. An electrode holder assembly as set forth in claim 23 wherein said cooling box includes a rear wall and said one-piece cylinder is mounted on said rear wall.

27. An electrode holder assembly as set forth in claim 26 wherein said one-piece cylinder includes a reduced diameter portion projecting through said rear wall into the cooling box.

28. An electrode holder assembly as set forth in claim 27 wherein said one-piece cylinder includes an enlarged portion fastened between said rear wall and the end of the mast arm.

29. An electrode holder assembly as set forth in claim 23 wherein said cooling box includes a front wall, said one-piece cylinder being mounted on said front wall.

* * * * *